US010100531B2

(12) United States Patent
Devos

(10) Patent No.: US 10,100,531 B2
(45) Date of Patent: Oct. 16, 2018

(54) PANEL

(71) Applicant: FLOORING INDUSTRIES LIMITED, SARL, Bertrange (LU)

(72) Inventor: Pieter Devos, Koolskamp (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 14/894,072

(22) PCT Filed: May 14, 2014

(86) PCT No.: PCT/IB2014/061432
§ 371 (c)(1),
(2) Date: Nov. 25, 2015

(87) PCT Pub. No.: WO2014/191861
PCT Pub. Date: Dec. 4, 2014

(65) Prior Publication Data

US 2016/0115695 A1 Apr. 28, 2016

(30) Foreign Application Priority Data

May 30, 2013 (BE) ..... 2013/0382

(51) Int. Cl.
*E04F 15/02* (2006.01)
*E04F 15/10* (2006.01)

(52) U.S. Cl.
CPC ..... *E04F 15/02038* (2013.01); *E04F 15/10* (2013.01); *E04F 2201/0146* (2013.01); *E04F 2201/0552* (2013.01)

(58) Field of Classification Search
CPC ..... E04F 2201/023; E04F 15/02038; E04F 19/061; E04F 19/06; E04F 19/02;
(Continued)

(56) References Cited

U.S. PATENT DOCUMENTS 6,647,690 B1 11/2003 Martensson
6,769,835 B2 8/2004 Stridsman
(Continued)

FOREIGN PATENT DOCUMENTS

CA 991373 A1 6/1976
DE 20008708 U1 9/2000
(Continued)

OTHER PUBLICATIONS

Belgium Search Report for corresponding Belgium Application No. BE201300382, dated Feb. 3, 2014.
(Continued)

*Primary Examiner* — Gisele D Ford
(74) *Attorney, Agent, or Firm* — Workman Nydegger

(57) ABSTRACT

A panel includes a horizontally and vertically active locking system allowing two floor panels to be connected to each other at the sides thereof by providing one of these floor panels via a downward movement toward the other panel. The vertically active locking system comprises a locking element in the form of an insert, and the locking element comprises at least a blocking body. The blocking body is substantially or entirely made of acrylonitrile butadiene styrene (ABS).

8 Claims, 7 Drawing Sheets

(58) Field of Classification Search
CPC ... E04F 13/0871; E04F 11/163; E04F 19/022; F16B 5/0056; F16B 5/00; F16B 5/0012; F16B 5/0004; E04B 2001/3276; E04B 1/34321; E04B 2002/7483; E04B 2001/3252; E04B 1/6804; E04B 1/6809; B27M 3/08; A47B 47/0075; A47B 2230/0096
See application file for complete search history.

(56) References Cited

U.S. PATENT DOCUMENTS

| | | | | |
|---|---|---|---|---|
| 6,854,235 | B2 | 2/2005 | Martensson | |
| 7,451,578 | B2 | 11/2008 | Hannig | |
| 7,603,826 | B1 | 10/2009 | Moebus | |
| 7,621,092 | B2 | 11/2009 | Groeke et al. | |
| 7,637,068 | B2 * | 12/2009 | Pervan | B27F 1/02 52/582.1 |
| 7,980,043 | B2 | 7/2011 | Moebus | |
| 8,024,904 | B2 | 9/2011 | Hannig | |
| 8,132,384 | B2 | 3/2012 | Hannig | |
| 8,220,217 | B2 * | 7/2012 | Muehlebach | E04F 15/02 403/320 |
| 8,631,621 | B2 | 1/2014 | Hannig | |
| 8,966,853 | B2 | 3/2015 | Hannig | |
| 8,991,055 | B2 * | 3/2015 | Cappelle | E04F 15/02 29/897.3 |
| 2002/0031646 | A1 | 3/2002 | Chen et al. | |
| 2003/0180091 | A1 | 9/2003 | Stridsman | |
| 2004/0068954 | A1 | 4/2004 | Martensson | |
| 2004/0168392 | A1 * | 9/2004 | Konzelmann | E04F 15/04 52/589.1 |
| 2004/0211143 | A1 | 10/2004 | Hanning | |
| 2006/0101769 | A1 * | 5/2006 | Pervan | E04F 15/02 52/591.1 |
| 2007/0175156 | A1 * | 8/2007 | Pervan | B44C 1/28 52/582.1 |
| 2007/0193178 | A1 | 8/2007 | Groeke et al. | |
| 2008/0010937 | A1 * | 1/2008 | Pervan | E04F 15/02 52/588.1 |
| 2008/0010938 | A1 | 1/2008 | Hannig | |
| 2008/0110125 | A1 * | 5/2008 | Pervan | E04F 15/02 52/582.2 |
| 2008/0134613 | A1 * | 6/2008 | Pervan | E04F 15/02 52/582.2 |
| 2008/0134614 | A1 * | 6/2008 | Pervan | E04F 15/02038 52/588.1 |
| 2009/0019806 | A1 * | 1/2009 | Muehlebach | E04F 15/02 52/588.1 |
| 2009/0100782 | A1 * | 4/2009 | Groeke | E04F 15/02 52/589.1 |
| 2009/0193748 | A1 * | 8/2009 | Boo | B27F 1/02 52/589.1 |
| 2009/0249733 | A1 | 10/2009 | Moebus | |
| 2010/0043333 | A1 * | 2/2010 | Hannig | E04F 15/02 52/582.2 |
| 2010/0281803 | A1 * | 11/2010 | Cappelle | E04F 15/02 52/309.1 |
| 2011/0088346 | A1 | 4/2011 | Hannig | |
| 2011/0173914 | A1 * | 7/2011 | Engstrom | E04F 15/02038 52/582.2 |
| 2011/0271632 | A1 * | 11/2011 | Cappelle | E04F 15/02 52/582.2 |
| 2012/0011796 | A1 | 1/2012 | Hannig | |
| 2013/0042562 | A1 * | 2/2013 | Pervan | E04F 15/02038 52/582.2 |
| 2014/0150369 | A1 | 6/2014 | Hannig | |

FOREIGN PATENT DOCUMENTS

| | | | |
|---|---|---|---|
| DE | 20112474 | U1 | 12/2002 |
| DE | 29924454 | U1 | 5/2003 |
| DE | 102004055951 | A1 | 7/2005 |
| DE | 102004001363 | A1 | 8/2005 |
| DE | 102005002297 | A1 | 8/2005 |
| DE | 202007000310 | U1 | 4/2007 |
| EP | 1159497 | B1 | 12/2001 |
| EP | 1282752 | A1 | 2/2003 |
| EP | 1350904 | A2 | 10/2003 |
| EP | 1415056 | A1 | 5/2004 |
| EP | 1818478 | A1 | 8/2007 |
| JP | H07300979 | A | 11/1995 |
| SE | 515324 | C2 | 7/2001 |
| WO | 1997047834 | A1 | 12/1997 |
| WO | 2004079130 | A1 | 9/2004 |
| WO | 2005054599 | A1 | 6/2005 |
| WO | 2006043893 | A1 | 4/2006 |
| WO | 2006104436 | A1 | 10/2006 |
| WO | 2007008139 | A1 | 1/2007 |
| WO | 2007015669 | A2 | 2/2007 |
| WO | 2007079845 | A1 | 7/2007 |
| WO | 2009066153 | A2 | 5/2009 |
| WO | 2010082171 | A2 | 7/2010 |

OTHER PUBLICATIONS

International Search Report for corresponding International PCT Application No. PCT/IB2014/061432, dated Nov. 4, 2014.

* cited by examiner

PANEL

BACKGROUND OF THE INVENTION

1. Field of the Disclosure

This invention relates to a panel, such as, for example, to a floor panel, a ceiling panel, a wall panel or the like.

More particularly, it relates to a panel comprising on at least two opposite sides coupling parts, in the form of a male coupling part and a female coupling part, respectively, which allow connecting two of such panels to each other at said sides or, in other words, can be brought in a coupled condition by providing one of these panels with the pertaining male part via a downward movement in the female part of the other floor panel, such that thereby at least a locking in horizontal direction is obtained.

2. Related Art

Couplings allowing that two panels, such as floor panels, can be coupled to each other by joining one floor panel with a downward movement in the other, in practice are divided into two kinds, namely a first kind where the coupling parts provide exclusively for a horizontal locking without any locking in vertical direction, and a second kind where both a horizontal and a vertical locking are provided.

The couplings of the first kind are also known as so-called "drop-in" systems. Floor panels which are equipped therewith on two opposite sides are known, amongst others, from CA 991 373 and JP 07-300 979. As becomes clear from these patent documents, such "drop-in" systems often will be applied on a first pair of opposite sides of the floor panels only, whereas then on the second pair of opposite sides coupling parts are applied which, in the coupled condition of two floor panels, provide for a vertical as well as a horizontal locking and which allow coupling two of such floor panels to each other by means of a turning movement. Floor panels with such a combination of coupling parts offer the advantage that they are easy to install in successive rows, simply by coupling each new floor panel to be installed to the preceding row of floor panels by means of the turning movement and, during pivoting it down, providing for that such floor panel simultaneously also engages in an already installed preceding floor panel of the same row. Thus, installing such floor panel requires a turning and putting-down movement, which is a particularly user-friendly installation technique.

A disadvantage of floor panels having such coupling parts consists in that on the surface, due to the fact that there is no locking in vertical direction, height differences may occur among the coupled floor panels. So, for example, such floor panels in a first or last row of a floor covering can turn back up from their flat position if not being held down by a baseboard or the like. Even if such floor panels are provided with a "drop-in" system on only one pair of sides, whereas on their other pair of sides, they are locked both in horizontal and vertical direction in respect to adjacent floor panels, height differences may occur among adjacent floor panels at the sides which are coupled by the "drop-in" system, amongst others, when two adjacent floor panels are subjected to a different load or when one floor panel would warp somewhat in respect to the other.

Couplings of the aforementioned second kind, also called "push-lock" systems, attempt to remedy said disadvantage by also providing a vertical locking. Such so-called "push-lock" systems can be divided into two different categories, namely one-piece embodiments and embodiments comprising a separate locking element which is made as an insert, which, whether fixedly or not, is attached to the actual floor panel.

One-piece embodiments are known, amongst others, from the patent documents DE 299 24 454, DE 200 08 708, DE 201 12 474, DE 10 2004 001 363, DE 10 2004 055 951, EP 1 282 752 and EP 1 350 904. The known one-piece embodiments have the disadvantage that they work rather stiffly and that a good joining of two floor panels cannot always be guaranteed.

Embodiments comprising a separate locking element which contributes to a vertical and possibly also horizontal locking between two coupled floor panels are known, amongst others, from the patent documents DE 20 2007 000 310, DE 10 2004 001 363, DE10 2005 002 297, EP 1 159 497, EP 1 415 056 B1, EP 1 818 478, WO 2004/079130, WO 2005/054599, WO 2006/043893, WO 2006/104436, WO 2007/008139, WO 2007/079845, WO 2009/066153, WO 2010/082171 and SE 515324. The use of a separate locking element offers the advantage that the material thereof is independent from the actual floor panel and thus can be chosen optimally in function of the application. In this manner, such inserts can be realized from synthetic material or metal, as a result of which relatively strong, however, still easily movable locking portions can be realized which can take up relatively large forces with a minimum contact surface.

The present invention relates to panels or floor panels which are equipped with a "push-lock" system of the last-mentioned category, in other words, which comprise an insert, whether or not fixedly attached, however, separately realized. The target of the invention consists in further optimizing these "push-lock" systems in floor panels.

SUMMARY OF THE DISCLOSURE

The invention relates to panels, and in particular to floor panels, which are of the specific type:

- which comprises, at least on two opposite sides, coupling parts with which two of such panels or floor panels can be coupled to each other;
- wherein said coupling parts form a horizontally active locking system and a vertically active locking system;
- wherein the horizontally active locking system comprises a male part and a female part, which allow that two of such floor panels can be connected to each other at said sides by providing one of these floor panels with the pertaining male part via a downward movement in the female part of the other floor panel;
- wherein the vertically active locking system comprises a locking element which, in the form of an insert, is provided in one of the respective sides.

Floor panels of this type are known, amongst others, from FIGS. 5-7, 8 and 9-11 of said EP 1 415 056 B1. In these known embodiments, the locking portion made in the form of an insert consists of a synthetic material strip with an elastically bendable lip, which, during its bending, functions as a pivotable blocking body. These known embodiments show the advantage that by means of a relatively simple construction a so-called "push-lock" connection can be realized which is active over the entire length of the synthetic material strip. However, practice has shown that this known embodiment does not always function smoothly.

From WO 2009/066153 and WO 2010/082171 in the meantime locking elements are known which, apart from a pivotable blocking body, also comprise an attachment portion, for example, in form of a clamped part, wherein this attachment portion retains the strip in the recess, and still further comprise a bending zone of a material different from the material of the blocking body. The insert known from the aforementioned documents substantially is made from PVC (Polyvinyl chloride). Although the locking elements disclosed there offer a compromise between vertical locking strength, by means of the rigid blocking body, and a supple coupling movement, by means of the bending zone especially provided for this purpose, such strip may cause problems during the actual coupling. The strips known from the aforementioned documents show the disadvantage that the blocking body, during coupling in vertical direction, can be pushed out of its desired position and/or that during coupling damage can be caused at the panels, in particular when the insert is situated on that side of the panel which is equipped with the male part. In such case, the insert, during the downward coupling movement, may touch the decorative surface on the edge equipped with the female part. With relatively brittle surface layers, such as with laminate layers on the basis of melamine, urea formaldehyde or phenol formaldehyde or with varnish or lacquer layers, for example, as a finish in the case of wooden top layers, this may lead to an undesired crumbling or chipping of the layer concerned.

From WO 2006/043893 and WO 2007/015669, locking elements are known wherein these locking elements are made as an insert having a block-shaped cross-section, which insert is provided in one of the sides in a so-called displacement groove, and wherein this locking element can be bent in the horizontal plane, such that it moves twice in said displacement groove. The inserts known from these documents can be formed, for example, from polypropylene. There is a risk of blocking of the bendable insert in the displacement groove.

The present invention in first instance aims at alternative panels of the aforementioned specific type, which panels, according to various preferred embodiments thereof, are improved further in respect to the aforementioned known embodiments, wherein these improvements allow, for example, obtaining a smoother coupling of two of such panels.

To this aim, the invention relates to a panel comprising on at least two opposite sides coupling parts with which two of such panels can be brought in a coupled condition; wherein these coupling parts form a horizontally active locking system and a vertically active locking system; wherein the horizontally active locking system comprises a male part and a female part, which allow that two of such panels can be connected to each other at said sides by providing one of these panels with the pertaining male part via a downward movement in the female part of the other panel; wherein the vertically active locking system comprises a locking element which, in the form of an insert, is provided in one of the respective sides; wherein this locking element comprises at least a blocking body; wherein the locking element consists of a strip which is attached in a recess in the panel, with the characteristic that said blocking body is substantially or entirely made of acrylonitrile butadiene styrene (ABS). A blocking body of ABS has an oil-like surface, as a result of which the friction of the blocking body with the remaining parts of the panel can be reduced. In particular, it is possible to extrude ABC with a smooth surface, for example, without having appreciable flow lines showing on the extruded surface. Hereby, a smoother and more reliable coupling without damage can be achieved.

Preferably, said blocking body on one extremity forms a stop-forming locking portion which can cooperate with a locking portion of a similar coupled panel.

It is clear that the strip can be made with a blocking body having a substantially block-shaped cross-section, or with a blocking body with an elastically bendable lip, or more particularly with a pivotable blocking body. Preferably, the locking element comprises an attachment portion which retains the strip in the recess. Herein, the attachment portion, according to a first possibility, may consist of a portion which extends in a continuous or more or less continuous manner along the respective side and in said recess, or, according to a second possibility, consist of one or more local portions spread along the respective side, wherein these local portions retain the strip in the recess on one or more locations.

The locking element can comprise a bending zone of a material different from the ABS material of the blocking body. The bending zone may be realized, for example, in polyurethane. Preferably, said bending zone relates to an elastic bending zone, which forms a connection, preferably the only connection, between the possible attachment portion and the blocking body. Also in the case that said bending zone is less elastic or not elastic, it preferably forms the only connection between the possible attachment portion and the blocking body.

According to a particular embodiment, said bending zone comprises a first boundary surface with said blocking body as well as a second boundary surface with said attachment portion, wherein said blocking body and the attachment portion, in uncoupled condition, in horizontal direction extend at least partially vertically underneath each other, wherein points of the first as well as the second boundary surface are situated on a vertical line one above the other and wherein said first boundary surface, in said uncoupled condition of the panels, globally seen extends in a direction which forms an angle of less than 45° with the upper surface of the panels.

Within the scope of the present invention, by uncoupled condition a condition is meant wherein the insert is provided in the recess, however, wherein the respective panel at the side with the insert is not coupled to another similar panel and is not in any stage of a started coupling movement.

Thus, according to the above-mentioned particular embodiment, it is achieved in the uncoupled condition that portions of the blocking body and the attachment portion engage underneath each other or hook underneath each other. By the position of the respective boundary surfaces, namely a position in which they comprise at least points on a vertical line above one another, the risk of the occurrence of sliding off in the bending zone is restricted. Preferably, the respective boundary surfaces extend underneath each other at least for a third and still better for half of the smallest boundary surface. A further restriction of such sliding off is achieved in that the first boundary surface, globally seen, forms a limited angle with the horizontal. Preferably, this angle is smaller than 30° or even smaller than 20°. The combination of these measures leads to a restriction of the degree to which the blocking body can be pushed out of its desired position during the downward coupling movement.

In that the aforementioned measures, or, in other words, the characteristics of the above-mentioned particular embodiment, are at least present in the uncoupled condition, the invention promotes the smoothness of the coupling at least at the beginning of the downward coupling movement. The combination of said measures, namely that said blocking body and the attachment portion in horizontal direction at least partially extend underneath each other, wherein points of the first as well as of the second boundary surface are situated on a vertical line above one another and wherein the first boundary surface, globally seen, extends in a direction which forms an angle of less than 45°, or still better less than 30° or less than 20°, with the horizontal, preferably is also present in a condition wherein said blocking body is situated entirely underneath the upper side of that panel to which it is attached and/or in the coupled condition of two of such panels. It is evident that such preferred embodiments further promote the smoothness of the coupling movement. It is clear that the condition in which said blocking body is situated completely underneath the upper side of that panel to which it is attached, herein relates to an ultimate condition which can be achieved during the coupling movement, or at least a condition close to this. Also in one or more of these conditions, it is preferred that the respective boundary surfaces extend vertically underneath each other in horizontal direction at least for a third and still better for half or more of the smallest boundary surface.

As aforementioned, the blocking body preferably relates to a pivotable blocking body. However, it is not excluded that the blocking body relates to a strip which is movably positioned in the aforementioned recess. This may relate, for example, to a strip, which, seen in cross-section, can be shifted in a plane, either a horizontal plane or in another plane perpendicular to said cross-section, for example, in a plane forming an angle of 0 to 50 degrees with the horizontal plane. The shifting as such may result from a bending of the respective strip in this plane. With a strip which is movably positioned in the recess, by means of the ABS material a significant reduction of the risk is achieved that the blocking body, when performing the downward coupling movement, would get stuck in the recess. To wit, when performing the downward coupling movement, the blocking body herein must be moved in the recess, and towards the end of the coupling movement, such blocking body automatically has to move back into the direction of the starting position in order to come into contact with the locking portion of the other panel to be coupled thereto.

Preferably, the aforementioned locking element is provided as an insert in a recess in the aforementioned male part. In the case of a pivotable blocking body, this preferably is directed upwards with its stop-forming locking portion. In such case, this blocking body preferably, in the uncoupled condition, has a surface which, when performing said downward movement, comes into contact with the upper edge of the other panel, wherein this surface, when said contact is achieved, has a tangent line in the contact point which forms an angle of 20° to 45° with the upper surface of the panels. Such feature promotes a smooth coupling of two of such panels on the respective sides, also in that case when the upper edge at these sides, or at least the side with the female part, is made straight, namely, without chamfers or other deepened parts. Preferably, at least the aforementioned surface, which, when performing said downward movement, comes into contact with the upper edge of the other panel, is made in ABS. In this manner, an extremely smooth coupling can be achieved without damage to a possible brittle top layer of the panels.

Preferably, the blocking body is free from portions extending beyond said tangent line on said surface. Such portions may hamper the coupling. Preferably, the blocking body actually has a widened cross-section at the extremity with the locking portion, wherein this widening results in a protrusion on the side of the blocking body opposite to the surface coming into contact with the upper edge of the panel which has to be coupled thereto.

It is noted that achieving a smooth coupling is of particular interest with panels comprising a decorative top layer which comprises melamine or other thermo-hardening or other brittle transparent layers, such as layers on the basis of UV-hardened or electron beam-hardened lacquer or layers on the basis of varnish. With such panels, it is best to avoid having to tap on the panels, for example, with a hammer, in order to couple them to each other.

Preferably, the blocking body relates to a pivotable blocking body, wherein this blocking body, opposite to the extremity forming the locking portion, comprises a support portion which is pivotable against a support surface pertaining to the respective panel, and, for example, more particularly, in a seat. Preferably, said support portion is in the form of a, whether or not free, extremity of the blocking body which, at least in vertical direction, is positively supported by a support portion or support surface pertaining to the panel or floor panel. Preferably, said support surface extends in horizontal direction at least partially vertically underneath said first boundary surface.

In the cases in which the support portion is made as a free extremity, it does not experience any influences of adjacent material parts in its support portion, which is beneficial for a smooth hinge movement of the blocking body. By a free extremity substantially is meant that this simply is made as a protruding leg to which further no parts are attached.

In the cases wherein the support portion is made otherwise than as a free extremity, a pressing-on effect can be obtained by an adjacent material part, which can result in a more stable coupling.

Preferably, the blocking body is pivotable around a pivot point, for example, around said support point or around a point of the support surface.

Preferably, the panel of the invention has a thickness of 15 millimeters or less, 12 millimeters or less, or still better a thickness of 9.5 or 8 millimeters or less. Preferably, the thickness, however, is greater than 4 millimeters. Of course, it is not excluded to apply the invention with thicker panels, such as panels having a thickness of 12 millimeters to 18 millimeters. Preferably, in such case this concerns so-called engineered wood panels or panels for prefabricated parquet.

Preferably, the panel of the invention concerns a panel which substantially is composed of a core material and a decorative top layer. Possibly, a backing layer can be applied on the side of the core material opposite to the top layer. According to the most preferred embodiment, for the core material a wood-based board material, such as MDF or HDF (Medium Density Fiberboard or High Density Fiberboard) is used. In particular with such panels there is a risk of damaging the top layer during coupling. Preferably, the decorative top layer substantially consists of synthetic material and/or paper, wherein the decorative top layer preferably comprises a printed motif. Such panels can be composed according to various possibilities. Below, some possibilities will be discussed in more detail.

According to a first possibility, the panel relates to a laminate panel of the type DPL or HPL (Direct Pressure Laminate or High Pressure Laminate), wherein for the decorative top layer at least use is made of a printed or colored paper layer on which a transparent layer of melamine resin is present. Possibly, this melamine resin as such can also include a transparent paper layer and/or hard particles. According to this first possibility, preferably a core material is applied which consists of HDF or MDF, and at the underside of the core material preferably a backing layer is applied which comprises a paper layer and melamine resin. Such backing layer offers a balancing effect for possible residual tensions which can be present in the top layer. According to the DPL principle, the composing layers and the core material of such panel are hardened and adhered to each other in a single pressing step. According to the HPL principle, the composing layers of the top layer of such panel are hardened before being adhered to the core material in a subsequent step.

According to a second possibility, the panel relates to a directly printed laminate panel, wherein the decorative top layer is formed at least by performing a print on the core material, whether or not by the intermediary of one or more primer layers, for example, by means of offset printing or a digital printing process, such as inkjet printing. For obtaining a certain wear resistance, such print can be finished further with one or more transparent lacquer layers or melamine layers, such as with one or more UV-hardened or electron beam-hardened lacquer layers. Such transparent layers further may also comprise hard particles. According to this second possibility, preferably a core material is used which consists of HDF or MDF and at the underside of the core material preferably a backing layer is applied, which preferably provides for a vapor-tight barrier, for example, by means of a lacquer. According to this second possibility, a panel can be offered which is free from paper layers in the top layer and possibly in the backing layer as well.

Preferably, the decorative top layer is realized with a thickness which is smaller than 1 millimeter, or even smaller than 0.5 or 0.3 millimeters. This is usually the case with the panels of the above first and second possibilities. The invention shows its advantages best in particular with such panels. Namely, by means of the particular insert of the invention a smoother vertically active locking system can be obtained. By means of the invention further a coupled condition can be obtained in which there are no or almost no height differences between the adjacent upper edges of the coupled panels. In any case, a possible height difference preferably is restricted to a maximum of 0.2 millimeters or even of 0.1 millimeters or less, such that the core material remains hidden. Minimizing height differences is of particular interest with such thin top layers, as they can undergo a relatively fast wear in use as a result of a repeated impact on upper edges which are protruding too much. In particular with decorative top layers which comprise melamine or other thermo-hardening or other brittle transparent layers, such as with layers on the basis of UV-hardened or electron beam-hardened lacquer, it is relevant to avoid excessive height differences.

It is noted that on the coupled edges or sides possibly an inclined portion or other chamfer can be provided according to any technique. However, the invention shows its advantages in particular with panels having straight upper edges.

Preferably, the locking element is provided in a recess and, in the uncoupled condition, it is seated with its locking portion entirely outside of said recess.

Preferably, the locking element consists of a coextruded synthetic material strip provided in a recess, which synthetic material strip, seen in cross-section, is composed of two or more zones consisting of synthetic materials with different features, wherein at least one of these synthetic materials concerns ABS. The use of such coextruded synthetic material strip offers the advantage that the features can be chosen depending on the function which have to be exerted by certain components of such strip. It is clear that the invention can also be applied with synthetic material strips which substantially or exclusively consist of the same ABS material.

As aforementioned, the locking element, according to an important embodiment, is provided in the aforementioned male part. It is noted again that with such embodiment a smooth coupling movement is particularly critical, as, when performing the downward movement, the blocking body is pushed inwards by means of a contact with the upper edge of the other panel. Such upper edge forms a guiding surface for the blocking body which is far from ideal, certainly in the cases where a straight upper edge is applied, but also in the cases wherein a chamfer or other deepened edge is provided on this upper edge. This contact with the upper edge of the other panel can result in a pushing-up of the locking element, and the locking element can be pulled out of its position in such a manner that the coupling becomes impossible. Moreover, said upper edge may be damaged. As now, according to the invention, ABS is applied, a smoother guiding of the blocking body beyond the upper edge can be obtained.

It is noted that the present invention preferably is applied with embodiments wherein the locking element made as an insert substantially, and still better exclusively, serves as a locking element which assists in the vertical locking and thus not in the horizontal locking. The horizontal locking preferably is performed exclusively by parts, such as the aforementioned male part and female part, which are realized from the actual panel material or substrate material, more particularly are formed from it by machining more particularly, the invention preferably also relates to embodiments wherein the insert is produced separately and then is mounted in an edge of an actual floor panel, whether or not in a fixed manner.

Further, it is noted that the locking systems of the invention are of particular interest for being applied in panels having a useful panel surface of more than 0.4 or more than 0.45 square meters. According to a particular embodiment, this concerns panels having a useful panel surface of approximately half a square meter. Herein, this may relate to oblong panels with a length of more than 2 meters and a width of approximately 20 centimeters or more, or to oblong panels with a width of 40 centimeters or more and a length of 1 meter or more, or to square panels with a side of 60 centimeters or more. By means of the locking systems of the invention, a particularly handy installation for these less manageable large panels can be achieved.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE DISCLOSURE

As represented in FIGS. 1 to 6, the invention relates to a floor panel 1 comprising on at least two opposite sides 2-3 coupling parts 4-5 with which two of such panels 1 can be coupled to each other.

Figure 3:
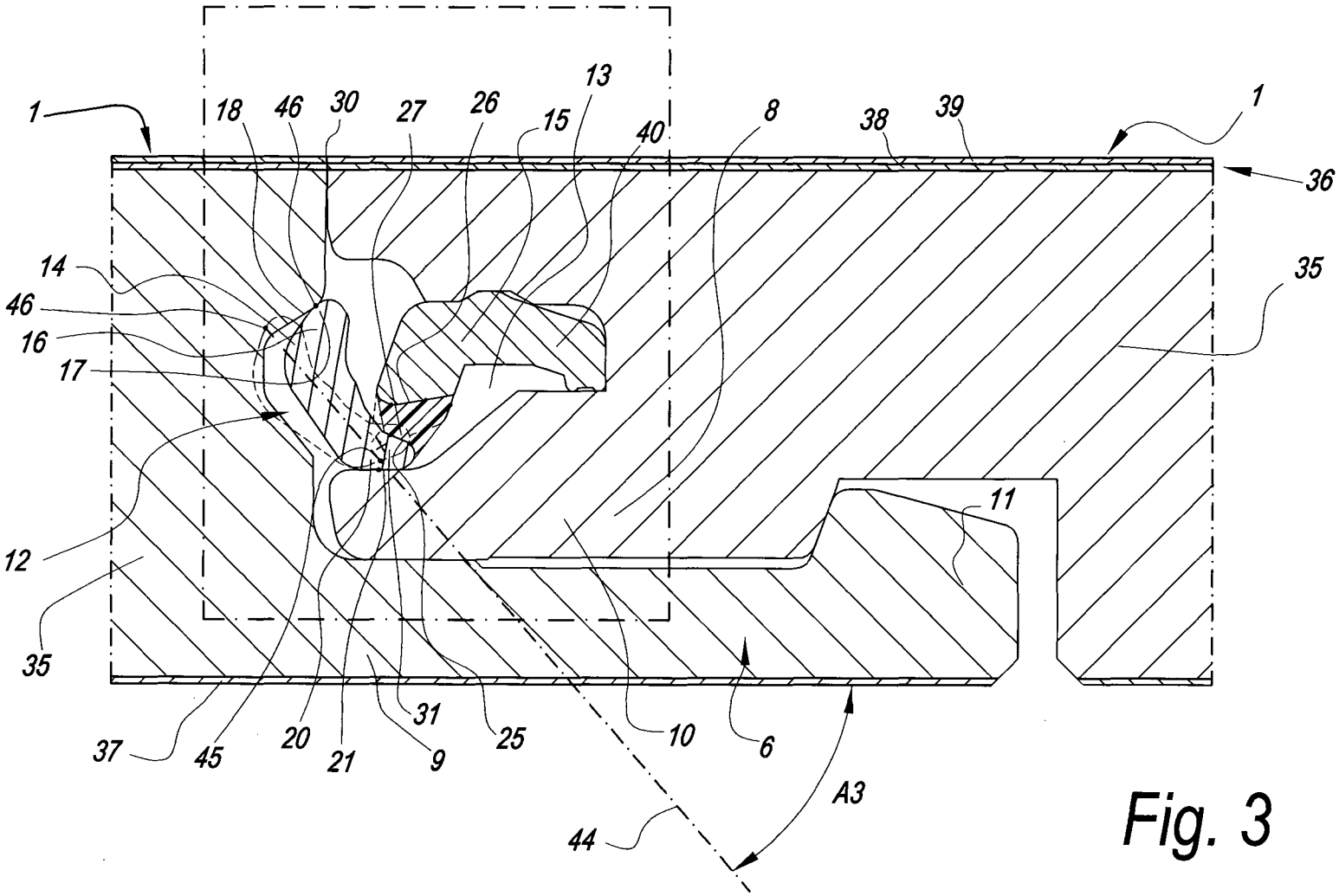
FIG. 3 in cross-section represents two floor panels, which are realized according to FIG. 2, in coupled condition.

As becomes clear from the coupled condition from FIG. 3, these coupling parts 4-5 comprise a horizontally active locking system 6 and a vertically active locking system 7. The horizontally active locking system 6 comprises a male part 8 and a female part 9, which allow that two of such floor panels 1 can be connected to each other at said sides 2-3 by providing one of these floor panels 1 with the pertaining male part 8 via a downward movement M in the female part 9 of the other floor panel, which movement M is illustrated by means of the two different positions in FIGS. 4 and 5, and wherein FIG. 6 again represents the final locked position.

In the example, the male part 8 is formed by a downward-directed extremity of a hook-shaped part 10, whereas the female part 9 consists of a seat formed by means of an upward-directed hook-shaped part 11.

The vertically active locking system 7 comprises a locking element 12 which, in the form of an insert, is provided in one of the respective sides, in this case the side 2, more particularly in a recess 13 provided for this purpose. For clarification, the locking element 12, or thus, in other words, the insert, is depicted in separate condition in FIG. 7. As can be seen in this figure, this locking element 12 preferably is made as a strip. It is clear that this strip preferably extends over the entire or almost entire length of the side 2, for example, at least 75 or even at least 87 percent thereof. According to another possibility, a plurality of separate strips can bridge the entire or almost entire length of the side 2. Preferably, at least centrally on the length of this side 2 a strip is present, irrespective of the length over which this strip is extending.

In the example, this strip consists of synthetic material, and it is preferred that the strip has a continuous cross-section over its entire length, as a result of which it is easy to manufacture and/or to apply. Such strip can be produced, for example, by means of an extrusion technique and can be shortened to the desired length. Thus, the same continuous strip can be applied for panels of different dimensions, for example, each time shortened to measure of the respective side on which the strip must be provided. In the case of a synthetic material strip, preferably use is made of ABS. According to the invention, at least the blocking body 14 consists substantially, or in this case entirely, of ABS.

In the represented example, the locking element 12 is composed at least of a pivotable blocking body 14 and an attachment portion 15. In the embodiment of FIGS. 2 to 6, the blocking body 14 consists of the entire upright part, whereas the attachment portion 15 is formed by a part rather directed horizontally. Preferably, the attachment portion 15, as in all examples, however has a convex upper side and a concave underside. In this manner, the attachment portion can have an approximately constant wall thickness which corresponds to the wall thickness of the blocking body 14, however, is smaller than the global height of the recess 13 in which the locking element 12 or the strip is provided. The obtained bridge shape of the attachment portion 15 allows that the locking element 12 can be provided in a larger recess 13 in a stable and repeatable manner. A larger recess 13 can be realized in a simpler manner by means of milling tools. The bridge shape of the attachment portion 15 allows a certain deformation in respect of providing it in the recess 13, the height of which moreover does not necessarily have to be realized in an accurate manner. The attachment portion 15 preferably is also substantially realized in ABS. However, it is not excluded that here another, preferably synthetic, material might be applied.

Figure 1:
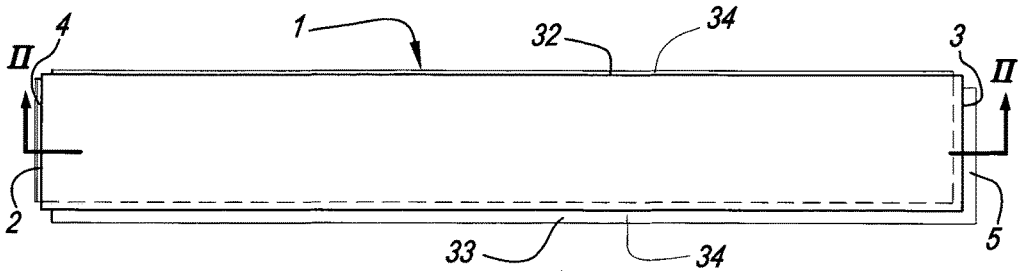
FIG. 1 schematically and in top view represents a floor panel according to the invention.
Figure 2:
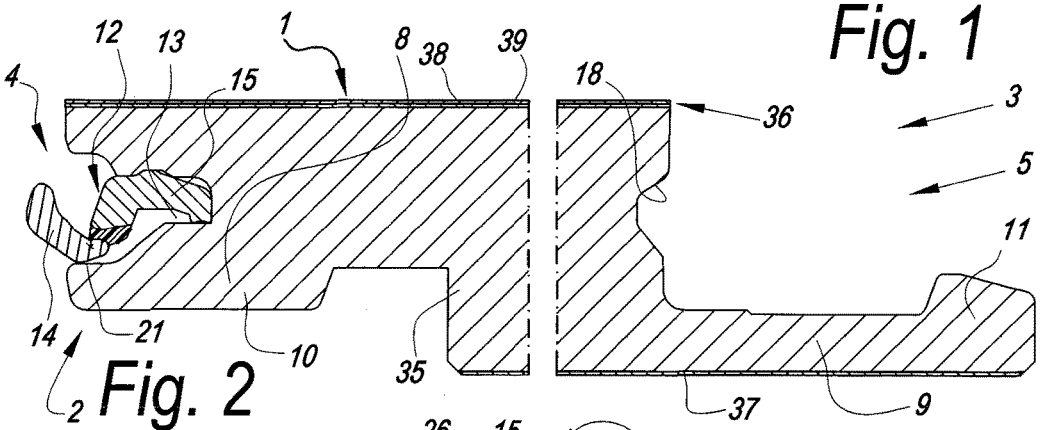
FIG. 2, at a larger scale, represents a cross-section according to line II-II in FIG. 1.
Figure 4:
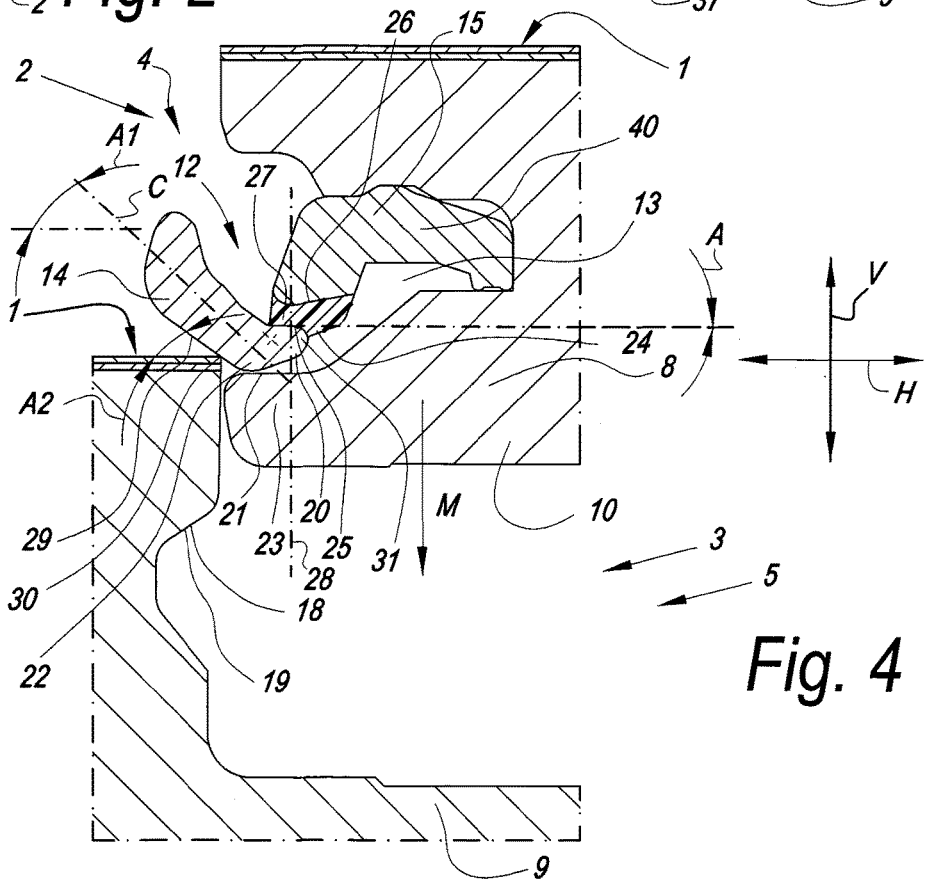
FIGS. 4 to 6, in a view on the area indicated by F4 in FIG. 3, represent the respective floor panels in various stages of the coupling movement.
Figure 5:
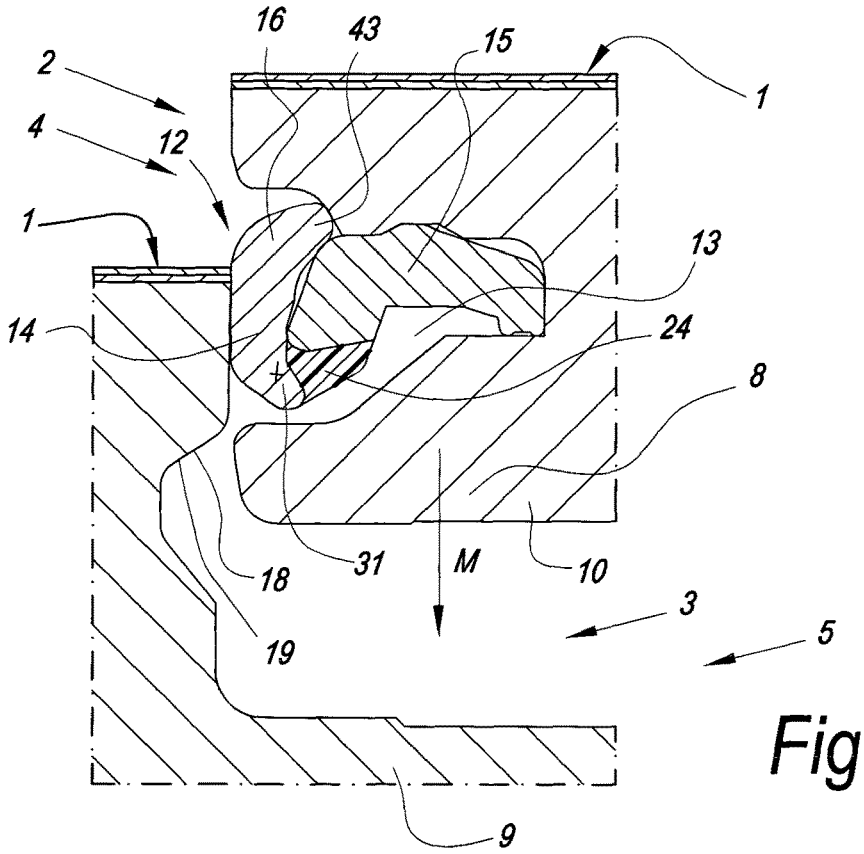
Figure 6:
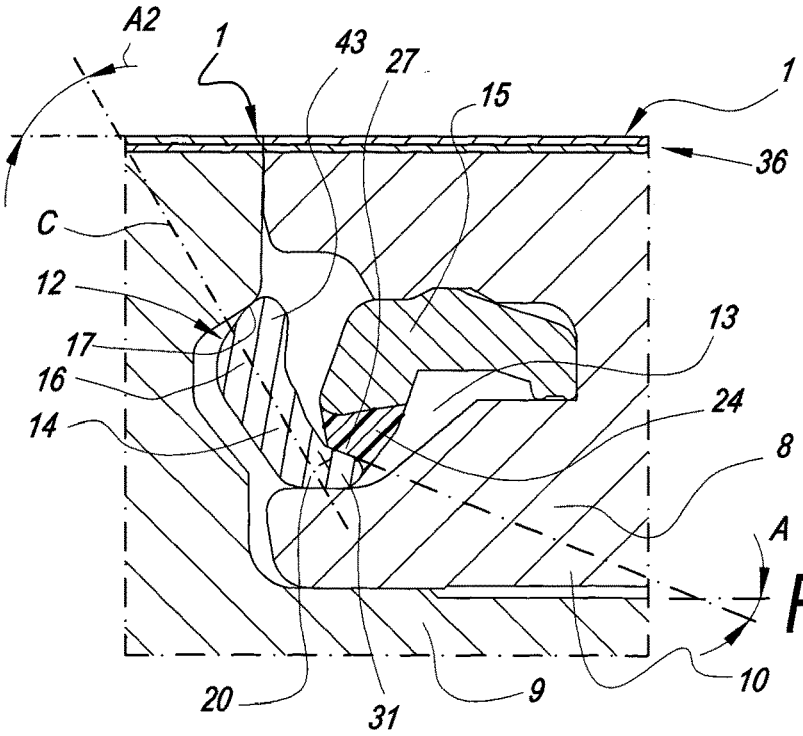

In the example, the extremity 16 which can be pivoted outward, of the blocking body 14 functions as a stop-forming locking portion 17, which can cooperate with a locking portion 18 of a similar coupled floor panel 1. Herein, the locking portion 18 preferably is formed by a portion which defines a stop-forming surface 19, which is present in the side 3 for this purpose and preferably is provided in the core of the floor panel 1 by means of machining. The functioning of the vertically active locking system can simply be deduced from the figures and is based on the principle that, as is represented in FIGS. 4 and 5, the blocking body 14, when lowering the respective floor panel, is elastically folded in by the contact with the edge of the other floor panel, after which, as soon as the floor panels have arrived in the same plane, the blocking element or blocking body 14 pivots back outward in order to position itself underneath the locking portion 18, such that the coupled condition of FIGS. 3 and 6 is achieved.

The pivotable blocking body 14, opposite to the extremity 16 forming the locking portion 17, in the extremity forms a support portion 20, which is pivotable against a support surface 21 pertaining to the respective floor panel 1. By support portion 20, in the embodiment of FIGS. 2 to 6 thus is meant the extremity 22 opposite to the locking portion 17, in this case the lowermost extremity, of the blocking body 14.

Further, the blocking body 14, in the example, between the support portion 17 and the support portion 20, in other words, between its extremities 16 and 22, as such is free from hinge portions and bending sections. To this aim, the blocking body 14 thus is also made relatively thick and preferably forms a rigid body, by which is meant that the blocking body 14 cannot undergo any noticeably deformations when pressures are exerted thereupon which usually may occur with "push-lock" couplings.

Further, the support portion 20 in the represented embodiment is realized as a free extremity which, at least in vertical direction, is positively supported by a support portion 23, more particularly support surface 21, pertaining to the floor panel 1.

Generally, it can be stated that the locking element 12 preferably consists of a strip, which is attached in a recess, in the represented example, thus, the recess 13, in the floor panel 1 and that hereby attachment portions are present which retain the strip in the recess. More particularly, it is preferred that the strip, such as here, is snapped into the recess and/or, according to a variant, is sitting enclosed therein due to the design. According to another variant, the attachment portion 15 in the recess 13 can be glued to the panel 1.

It is noted that other techniques for attaching or retaining such strip in the recess are possible, for example, by gluing, clamping or the like.

The embodiments illustrated by means of FIGS. 2 through 6 further also show the particular characteristics that the locking element 12 comprises a bending zone 25 of a material differing from the material of the blocking body 14, wherein this bending zone 24 comprises a first boundary surface 25 with said blocking body 14 as well as a second boundary surface 26 with said attachment portion 15. In this case, this concerns an elastic bending zone 24.

As represented in FIG. 4, in uncoupled condition the blocking body 14 and the attachment portion 15 extend in horizontal direction H at least for a portion 27 underneath each other. Herein, points of the first boundary surface 25 as well as of the second boundary surface 26 are situated on a vertical line, for example, on the line 28, on top of each other. In the examples, the first boundary surface 25 and the second boundary surface 26 extend underneath each other, at least for one third and here even for half of, or the entire, smallest boundary surface, wherein the smallest boundary surface in this case is the first boundary surface 25.

FIG. 4 further clearly shows that, in the uncoupled condition, the first boundary surface 25, globally seen, extends in a direction forming an angle A of less than 45° with the upper surface of the panels 1. In the example, the angle A, in the uncoupled condition, is less than 10° and here even approximately 0°.

FIG. 4 further also shows that the blocking body 14, in the uncoupled condition, can adopt an orientation wherein the central line C of the blocking body forms an angle A1 of less than 60° with the horizontal, or, in other words, with the upper surface of the panels 1 or the panel surface. In the example, this angle A1 is less than 50°, namely, approximately 45°.

Also as represented in FIG. 4, the blocking body 14 here shows a surface 29 which, when performing the coupling movement M, comes into contact with the upper edge 30 of the other panel. When said contact is achieved, as represented here, the respective surface 29, which in the example is situated on the downward-directed side of the blocking body 14, in the contact point has a tangent line 29A which forms an angle A2 of 20° to 45° with the horizontal or the upper surface of the panels. In this case, this angel A2 is approximately 35°.

The features illustrated by means of FIG. 4, all separately or in combination, are of particular interest when the strip is applied in the male part 8 and/or when the panel 1, with which a coupling has to be performed, has a straight upper edge 30, such as is the case in the examples.

FIG. 6 clearly shows that in this case preferred measures are present in the coupled condition of two of such panels 1. The blocking body 14 extends at least partially underneath the attachment portion 15, there are at least points, and preferably larger portions, of the first and second boundary surfaces 25-26 situated on a vertical line one above the other, and the first boundary surface 25 extends in a direction forming an angle A of less than 45° with the upper surface.

FIG. 5 shows a condition in which said blocking body 14 is situated entirely underneath the upper side or the upper surface of the panel 1 in which it is attached. Here, too, the blocking body 14 extends at least for a part 27 underneath the attachment portion 15, and at least points, and preferably larger portions, of the first and second boundary surfaces 25-26 are situated on a vertical line one above the other. In the example and in this condition, the first boundary surface 25, however, extends in a direction forming an angle A of more than 45° with the upper surface.

In each of the conditions represented in FIGS. 4 through 6, the blocking body 14 and the attachment portion 15 extend underneath each other in such a manner that they herein, in the respective condition, maintain a vertical distance between one another.

It is clear that the locking element 12, in the examples, is provided as an insert in a recess 13 in the male part 8 and that the blocking body 14 is directed upward with its locking portion 17. This relates to the most preferred embodiment of the invention. However, it is not excluded that the insert would be provided in the female part 9, wherein it then preferably would be directed downward with its locking portion 17.

FIGS. 3 and 6 further also show that said support surface 21, in the coupled condition of two of such panels 1, extends in horizontal direction preferably at least partially vertically underneath the first boundary surface 25. The same is valid for the support portion 20 of the blocking body 14.

FIGS. 2 through 7 illustrate another preferred characteristic of the invention, namely that the blocking body 14 comprises a hook-shaped protrusion 31 on its underside, or on the side which is directed away from the locking portion 15 thereof or the extremity 22, and that the portion with which the blocking body 14 extends underneath the attachment portion 15 concerns at least a part of this hook-shaped protrusion 31.

FIGS. 4 and 6 represent successive stages of the coupling movement M. FIG. 4 shows the condition at the beginning of the contact between blocking body 14 and the other panel 1 which has to be coupled with the respective panel 1. At that moment, a force is created in vertical direction V, which, apart from a turning of the blocking body 14, also can result in a pushing-up of the locking element 12 and a possible blockage. According to the invention, this is restricted by choosing the ABS material. FIG. 5 represents that it is not excluded that with the panels 1 of the invention, during coupling, a certain pushing-up of the locking element 12 may occur, however, this can be so limited that the smooth coupling is not endangered.

Figure 7:
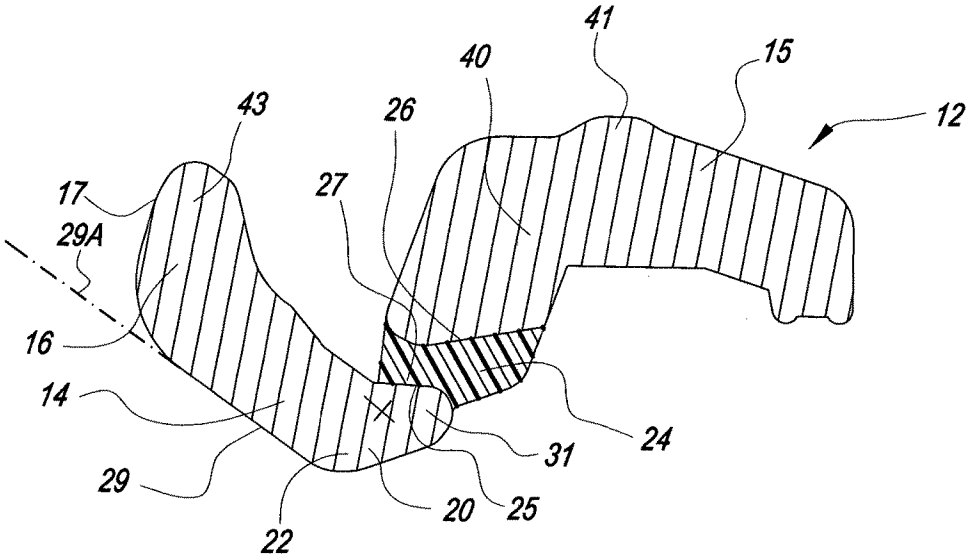
FIG. 7, at a larger scale, represents the insert of the floor panels from FIGS. 1 to 6.
Figure 11:
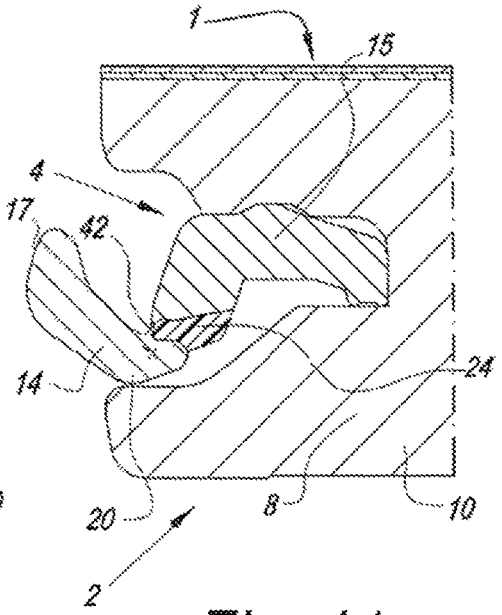

FIG. 7 further shows that the locking element 12 consists of a coextruded synthetic material strip, which, seen in cross-section, such as then in the view of FIG. 11, is composed of two or more zones, in this case of three zones, which consist of synthetic materials with different features, wherein at least one of these synthetic materials relates to acrylonitrile butadiene styrene (ABS). In the example, a first zone is formed by the pivotable blocking body 14, a second zone by the bending zone 24 and a third zone by the attachment portion 15. In this case, at least the blocking body 14 or the first zone is made of ABS. The bending zone 24 or second zone may be made, for example, of polyurethane or a polyurethane-based synthetic material, such as polyisocyanurate. Said third zone may be made of the same synthetic material or of a similar synthetic material as the aforementioned first zone.

Thus, the bending zone 24 preferably comprises an elastic material and more particularly a material which as such is suppler than the material of the blocking body 14. Preferably, this is also synthetic material, and in the most preferred embodiment, the bending zone 24, by means of coextrusion, is made in one piece with the blocking body 14. In the figures, the coextruded materials are represented with a different hatching.

In general, it is noted that a locking element 12 in cross section may have only small dimensions, in consideration of the fact that it has to be integrated into the edge of floor panels which, in practice, have a thickness which mostly is less than 2 cm and wherein the thickness in many cases is even less than 1 cm. The space which then is available for the locking element 12 thus often is also only in the order of magnitude of 5 millimeters or less. When with such small dimensions different supplenesses have to be incorporated into the locking element 12, the possibilities then will be limited if one wants to realize this in a traditional manner by working with different thicknesses. By making use of coextrusion, a wider range of possibilities is obtained for incorporating different supplenesses and thus also a different elasticity, depending on the intended effect.

It is noted that, as represented in the figures, the locking portion 17 of the blocking body 14 preferably is made in the form of a widened extremity of the blocking body 14, as a result of which more space is offered for realizing the locking portion with a desired surface. Such surface preferably is designed such that, when using the panels or floor panels, the blocking body 14 can pivot further outward and a vertical locking remains present and even an increasingly intense cooperation between the locking portion 17 and the locking portion 18 of the opposite panel 1 is created. So, for example, a so-called cam surface can be applied, as described in WO 2009/066153.

As represented in the figures, the locking element 12 and the recess 13 are made such that this locking element 12, in the free, uncoupled condition of the respective floor panel 1, is sitting with its locking portion 17 completely outward of the recess 13.

FIG. 6 further shows that the blocking body 14, in coupled condition, adopts an orientation in which the central line C of the blocking body 14 forms an angle A4 with the upper surface which is larger than the also above-defined angle A1. The difference is at least 5° and in this case even more than 10 or 15°. In this manner, a strong tensioning effect is obtained.

According to a preferred embodiment of the invention in general, the bending zone 24, in coupled condition, as in the examples, is under tensile stress, wherein this tensile stress forces the blocking body 14 to come back closer to its uncoupled condition, in which it forms a smaller angle with the upper surface. This tensile stress can ensure the contact between the locking portion 17 of the blocking body 14 against the locking portion 18 of the panel 1 coupled thereto. In such case, a continuous tension in the contact can be obtained.

The orientation of the first boundary surface 25 results in the coupled condition, as in FIG. 6, in a performant torque effect on the blocking body 14 as a result of the also above-mentioned tensile forces.

Preferably, said angle A4, as in the example of FIG. 6, is smaller than 90° and preferably also smaller than or equal to 60°, or smaller than 50°.

In the case of rectangular floor panels 1, either oblong or square ones, it is clear that on the second pair of opposite sides 32-33, too, coupling parts 34 can be provided, which, in coupled condition, preferably provide for a locking in a vertical direction perpendicular to the plane of the coupled panels 1, as well as for a locking in a horizontal direction in the plane of the coupled panels and perpendicular to the respective sides 32-33. These coupling parts 34 on the second pair of sides 32-33 can also be made as a "push-lock" coupling, whether or not in accordance with the present invention. Preferably, however, on the second pair of sides 32-33 coupling parts 34 will be applied which allow a mutual coupling by means of a turning movement W between two floor panels 1 to be coupled and/or by means of a shifting movement which results in a snap connection. Such coupling parts are widely known from the state of the art and are described, for example, in WO 97/47834.

Figure 8:
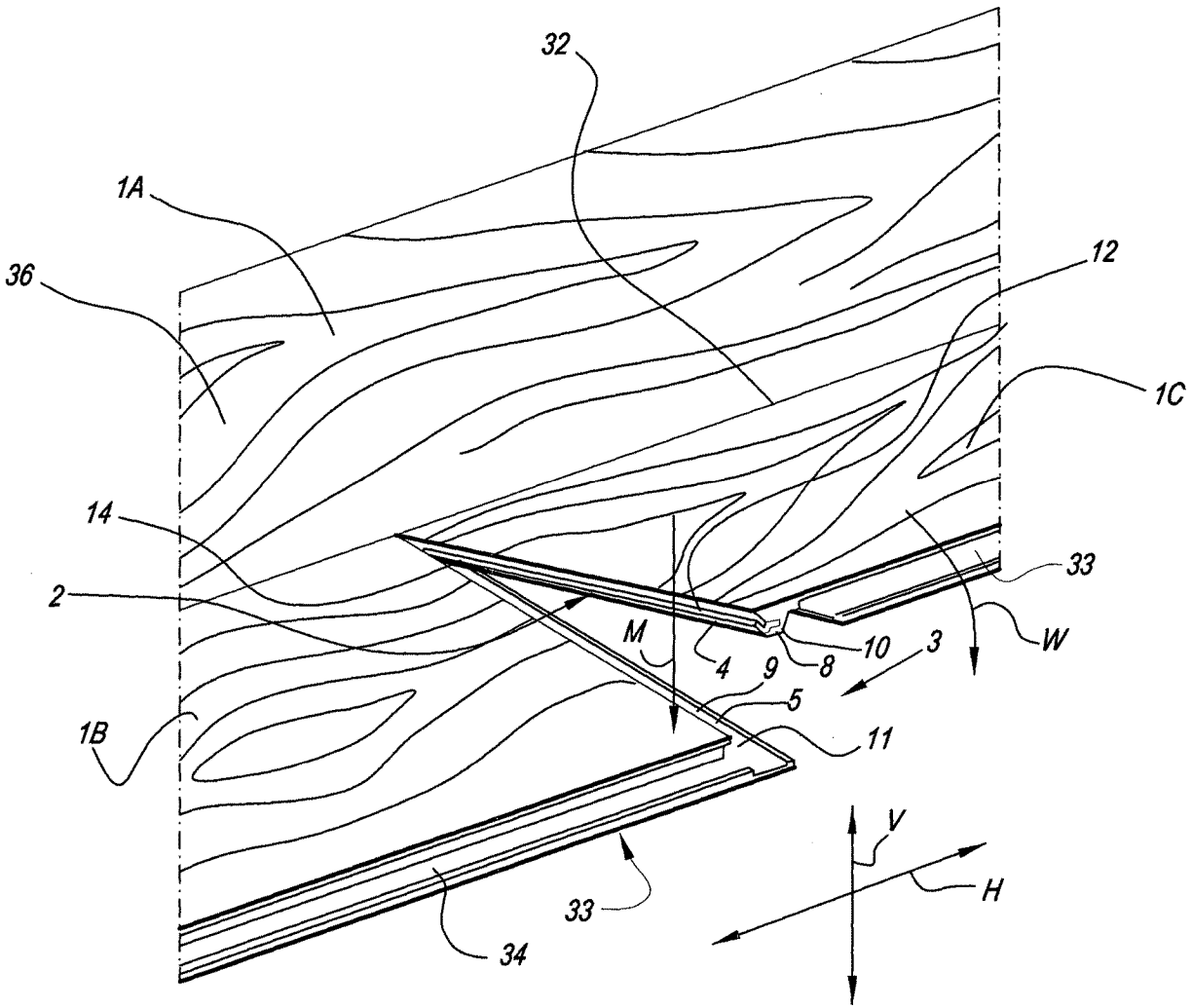
FIG. 8 in perspective represents how the floor panels of FIGS. 1 to 6 can be coupled to each other.

In the most preferred embodiment, on the second pair of sides 32-33 coupling parts 34 will be applied which allow at least a connection by means of a turning movement W, as this allows that the floor panels 1, as illustrated in FIG. 8, can be installed in a simple manner. A newly to install floor panel 1C then can be turned simply with its side 33 into the preceding row of floor panels 1A, just next to a preceding floor panel 1B in the same row. During turning down, the male part 8 of the newly to install floor panel 1C thus automatically engages in the female part 9 of the preceding floor panel 1B, without having to perform another operation. In the case of oblong floor panels 1, it is thus preferred that the so-called "push-lock" connection then is situated on the short sides 4-5.

It is clear that the coupling according to the invention can be applied in combination with any floor panel 1, such as in so-called prefabricated parquet, more particularly in so-called "engineered wood". In such case, this relates to floor panels which are composed of a core material 35 composed of strips, a top layer 36 of wood, as well as a backing layer of wood. The top layer 36 then consists of wood of a good quality, which functions as a visible decorative layer. The backing layer 37 can consist of a cheaper species of wood. The strips preferably also consist of a cheaper, for example, soft, species of wood. However, it is preferred that on the extremities of the floor panels 1 strips are applied consisting of a material which is relatively stable and is suitable for providing herein the desired profile forms, for example, milling them therein. In a practical embodiment, these strips consist of MDF (Medium Density Fiberboard) or HDF (High Density Fiberboard). It is clear that the invention can also be applied in combination with other forms of "engineered wood", for example, wherein the core consists of a single continuous MDF/HDF board or of a plywood board.

The figures each represent the application in panels which substantially consist of a core material 35 and a decorative top layer 36. More specifically, in the examples this relates to a laminate floor panel 1, in this case a so-called DPL (Direct Pressure Laminate), which, in a known manner, is composed of a core material 35, for example, of MDF or HDF, a top layer 36 on the basis of one or more resin-impregnated layers, for example, a printed decor layer 38 and a so-called overlay 39, as well as a backing layer 37, which also consists of one or more resin-impregnated layers, wherein the whole is consolidated under pressure and heat.

Of course, applications in other floor panels 1 are not excluded.

In general, the invention shows its advantages best with floor panels 1 having an overall thickness of less than 1 centimeter.

In general, it is preferred that a locking element 12 according to the invention provides for a stable support in vertical direction V, whereas in horizontal direction, thus, in turning direction, a supple movability is effected. Applying coextruded parts contributes to this.

By means of the invention, an improved snap-in effect is obtained with locking systems of the specific type mentioned in the introduction, in particular in those cases in which the blocking body 14 is directed upward. In such cases, the snapping-in in the systems of the state of the art may be somewhat hampered. As illustrated in FIG. 4, when coupling two such panels 1 by means of a downward movement M, the upward-directed blocking body 14 of ABS slides over a sharp edge, in this case over the upper edge 30 of the opposite panel. In the examples, the more flexible synthetic material of the bending zone provides for a more supple downward coupling movement M, wherein the risk of the tendency that the panels 1 are pushed out of each other in horizontal direction H and a qualitatively lesser coupling is created, is minimized. The invention is of particular interest when working with laminate panels 1. In this manner, the risk of damaging the thin top layer 36 of laminate when coupling the panels 1 is minimized.

According to the example from FIGS. 2 to 7, the blocking body 14 and the attachment portion 15, more particularly the clamping portion 40, in the uncoupled condition extend at least partially underneath each other, while still keeping a vertical distance in between them. In the coupled or uncoupled condition of two of such panels 1, in this case, in both, the aforementioned support surface 21 extends in horizontal direction H at least partially vertically underneath said, whether or not elastic, bending zone 24 and underneath said attachment portion 15 or more particularly the clamping portion 40.

Figure 9:
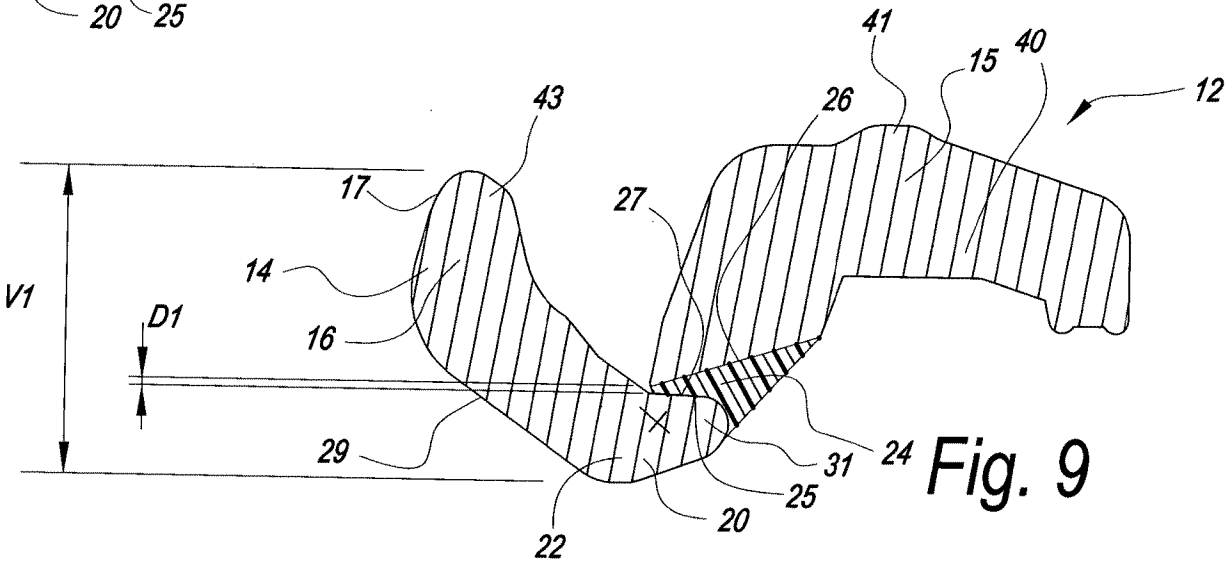
FIG. 9, in a view similar to that of FIG. 7, represents a variant of such insert, which can be applied as a locking element in the panels of the invention.

FIG. 9 further shows that the smallest vertical distance D1 between the respective portions of the blocking body 14 and the clamping portion 40, which extend underneath each other, is smaller than 0.4 millimeters, or at least is smaller than 5 percent of the vertical height V1 of the blocking body 14 in free condition. This is in the condition wherein the locking element 14 is not located in the recess 13. Such small distance D1 provides for a further minimization of sliding off in the bending zone 24 at the beginning of the coupling movement M. The extent to which the blocking body 14 can be pushed up is even more restricted than in the example of FIG. 8.

In the example of FIGS. 7 and 9, the locking element 12 comprises an elastic bending zone 24 forming a connection between the attachment portion 15 and the pivotable blocking body 14. This elastic bending zone 24 extends between the respective portions of the blocking body 14 and the attachment part 15, which extend underneath each other.

In the examples of FIGS. 7 and 9, said locking element 12 is provided in said male part 8, and said pivotable blocking body 14 is directed upward. Herein, the pivotable blocking body 14 extends in the coupled, however, in the uncoupled condition, too, horizontally at least for a part underneath the attachment portion 15 or clamping portion 40.

FIGS. 7 and 9 further also show that the blocking body 14 comprises a surface 29 which, when performing said downward movement M, comes into contact with the upper edge 30 of the other panel 1, wherein this surface 29, when said contact is effected, has a tangent line 29A in the contact point forming an angle A1 of 20 to 45° with the upper surface of the panels 1. This measure promotes a smooth mounting of the panels 1.

A particularity of the embodiment of FIGS. 7 and 9 is also that the insert, more particularly the clamping portion 40, is provided with a locking portion, in this case, a protrusion 41, which allows to snap this clamping part 40 into the core material 35 of the panel 1, more particular into a recess 13 in the core material 35 provided for this purpose.

The inserts from FIGS. 7 and 9 preferably consist of a coextruded synthetic material strip and as such form an object of the invention, wherein at least the blocking body consists substantially or entirely of ABS.

Figure 10:
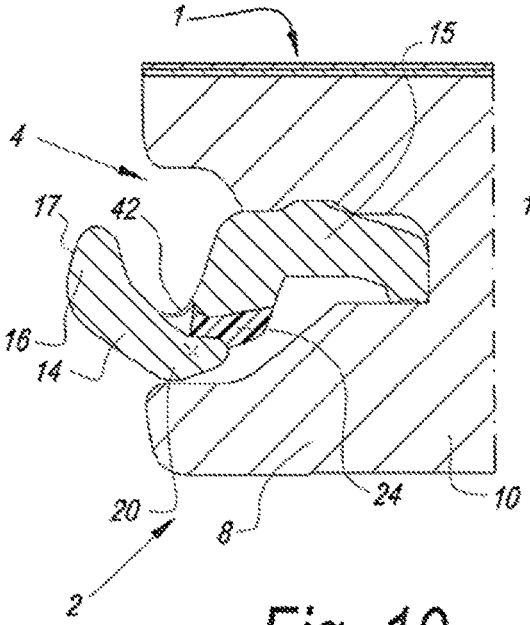
FIGS. 10 and 11, in a view similar to that of FIG. 4, represent some variants.

In the examples of FIGS. 7 and 9, the bending zone 24 forms a connection, in these cases even the only connection, between the blocking body 14 and the attachment portion 15. FIGS. 10 and 11 show that it is not excluded that apart from a connection through the bending zone 24 of another material than the blocking body 14, it is not excluded to work with an additional connection 42, whether or not of the same material as the blocking body 14. In the case of FIG. 10, this relates to an additional connection 42 by means of a separate film hinge formed from the same material as the blocking body 14. Here, by "separate" is meant that the material of the film hinge does make no or almost no contact with the material of the bending zone 24. In the case of FIG. 11, use is also made of an additional connection 42 by means of a film hinge formed from the same material as the blocking body 14. Contrary to the embodiment of FIG. 10, FIG. 11 relates to a film hinge which flanks or borders the bending zone 24.

With the locking elements 12 represented in the figures, the blocking body 14 as such each time is free from hinge portions and bending sections and thus forms a rigid body.

As illustrated in the figures, the blocking body 14 preferably is free from portions extending up to beyond the aforementioned tangent line 29A on said surface 29. Such portions may render coupling difficult. As in the examples, the blocking body preferably, however, has a widened cross-section at the extremity 16 with the locking portion 17, wherein this widening results in a protrusion 43 on the side of the blocking body 14 opposite to the surface 29 which comes into contact with the upper edge 30 of the panel 1 to be coupled thereto.

By the presence of the hook-shaped protrusion 31 and the protrusion 43, at the extremities 16 and 20, respectively, the locking elements 12 of the figures have a concave side directed towards the recess 13, whereas the surface 29, on the side of the locking element directed away from the recess 13, preferably, as in the examples, is made convex. FIG. 5 shows that the concave side in the condition concerned may cooperate with the attachment portion 15, which allows an additional stabilization of the locking element 12 during the coupling movement M. In the example of FIG. 5, the protrusion 43 on the extremity 16 with the locking portion 17 rests on top of the attachment portion 15.

It is also noted that there, where within the scope of the invention a vertical direction is mentioned, such as a locking in vertical direction, in fact reference is made to floor panels. In general, this means the direction perpendicular to the plane of the panels, independent from the fact whether this now relates to floor panels, ceiling panels, wall panels or other panels. Where a horizontal direction is mentioned, such as a locking in horizontal direction, reference is also made to floor panels. In general, hereby the direction in the plane of the panels and perpendicular to the respective edge of the panel is meant. Where a downward movement is mentioned, generally a movement is meant of the male coupling part towards the female coupling part in a direction extending transverse to the plane of the panels. Such movement on one pair of sides preferably is obtained as illustrated in FIG. 8, namely by performing a turning movement W at the second pair of sides. When upward-directed or downward-directed is mentioned, this in general means directed towards the decorative side, directed away from the decorative side, respectively.

It is clear that by useful surface of a panel the surface is meant which is visible or usable in the final covering, which consists of a plurality of such mutually coupled panels. In other words, this relates to the surface of the decorative side of the panels.

Figure 14:
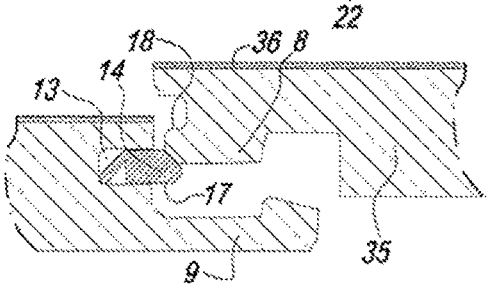
FIGS. 14 and 15, in a view similar to that of FIG. 13, however, at a smaller scale, represent variants.
Figure 15:
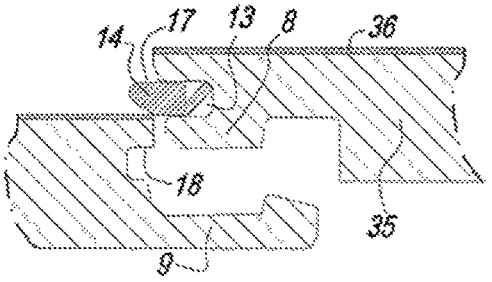

Further, it is clear that the invention can also be applied with other separate strips with blocking function in vertical direction than strips with pivotable blocking bodies. So, for example, may the invention also be applied with strips which comprise a blocking body which is slidable or bendable in a plane, for example, in a horizontal plane. FIGS. 14 and 15 represent an example thereof.

It is also noted that, in the cases in which the pivotable blocking body 14 of a locking element 12 is directed upward with its locking portion 17, it is particularly advantageous for the smoothness of the coupling when the central line C of the blocking body 14, in the uncoupled condition, forms an angle A1 of less than 60° and still better of less than 50° with the horizontal or the upper surface of the panels 1.

It is also noted that FIG. 3 also illustrates a preferred characteristic wherein, in uncoupled condition, a line 44 defined by, on the one hand, the tangent point 45 of the horizontal tangent line through the support portion 21 and, on the other hand, the central point 46 of the stop-forming locking portion 17, forms an angle A3 with the horizontal or the panel surface of less than 60°, less than 50° or still better of less than 45° or of approximately 40° with the panel surface. Herein, it is noted that the position of the central point 46 of the stop-forming locking portion 17 is determined in coupled condition, whereas said line 44 and the orientation related thereto, more particularly the angle A3 which is formed with the horizontal or the upper surface, as such is determined in the uncoupled condition.

Figure 12:
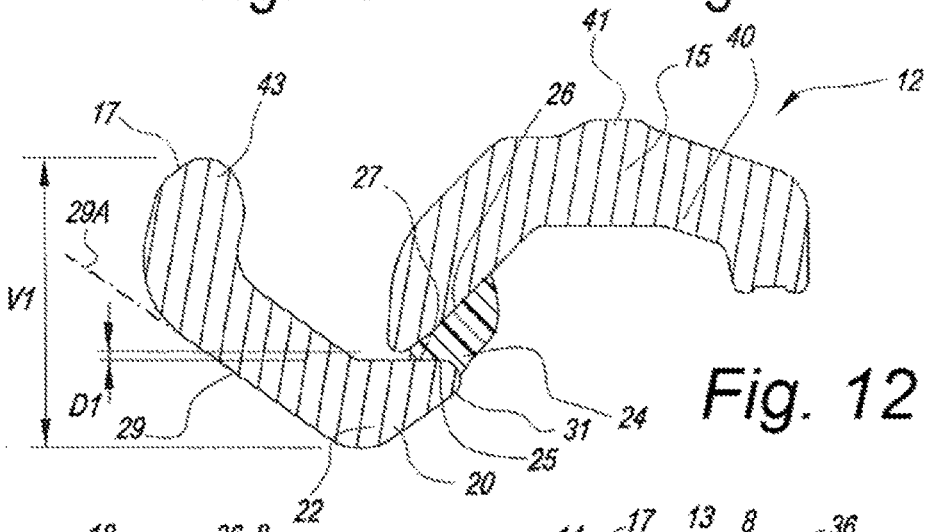
FIGS. 12 and 13, in views similar to those of FIGS. 7 and 3, respectively, represent another variant.
Figure 13:
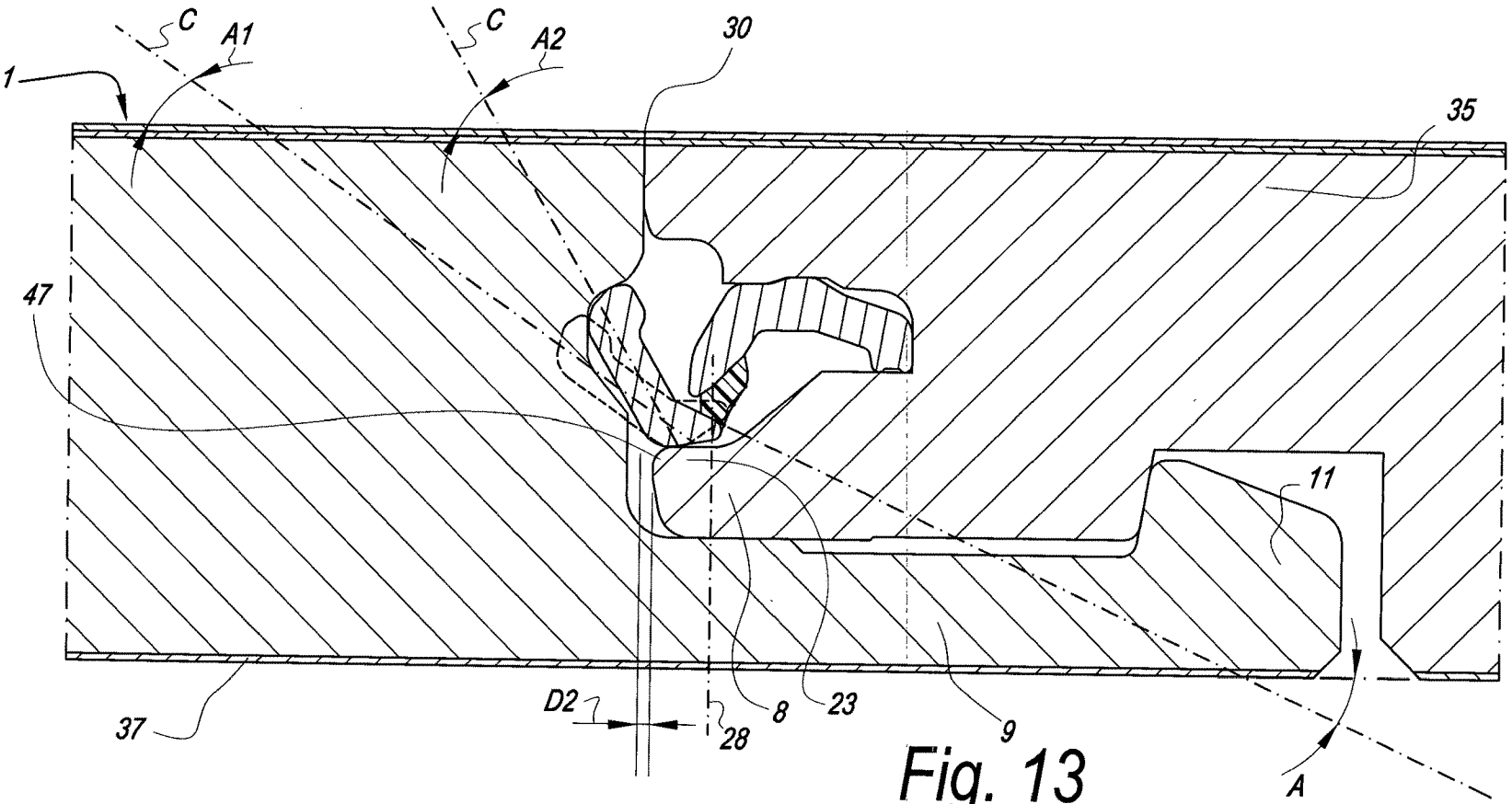

FIGS. 12 and 13 represent another variant of a locking element 12 and floor panels 1 in which such locking element 12 is applied. Herein, the blocking body 14, in the coupled condition, adopts an orientation wherein the central line C thereof forms an angle A4 with the panel surface which is larger than the angle A1 formed in the uncoupled condition. The difference between both angles is more than 10°. In this case, the difference is approximately 25°. In the coupled condition, the angle A4 is more than 50°, however, less than 90°. In this case, the angle A4 is approximately 60° and the angle A1 approximately 35°. Further, the first boundary surface 25, in coupled condition, forms an angle A of less than 45°, in this case approximately 25°, with the upper surface of the panels 1.

The locking element of FIG. 12 further also shows the particular characteristic that, at the location of the minimum vertical distance D1, there is a space between the attachment portion 15 and the blocking body 14.

The embodiment of the panels 1, as illustrated by means of FIG. 13, further also shows the particular characteristic that the distal extremity 47 of the support portion 23 only extends up to a distance D2 from the upper edge 30 and thus does not pass beyond the upper edge 30. Hereby is obtained that a smooth assembly remains possible even with not right-angled floor panels. The distance D2 preferably is between 0.1 and 0.5 millimeters.

It is also noted that, where the vertical distance D1 is mentioned, this relates to the minimum vertical distance between portions of the blocking body 14 and the attachment portion 15 which are located on the same vertical line. At the location of this vertical distance, there may or may not be a space situated between the blocking body 14 and the attachment portion 15.

The present invention is in no way restricted to the embodiments described by way of example and represented in the figures; on the contrary, such panels can be realized in various forms and dimensions without leaving the scope of the invention.

The invention claimed is:

1. A panel, comprising on at least two opposite sides coupling parts with which two of such panels can be brought in a coupled condition;

wherein these coupling parts form a horizontally active locking system and a vertically active locking system;

wherein the horizontally active locking system comprises a male part and a female part, which allow that two of such panels can be connected to each other at said sides by providing one of these panels with the pertaining male part via a downward movement in the female part of the other panel;

wherein the vertically active locking system comprises a locking element which is configured as a strip and which in the form of an insert is provided in one of the respective sides;

wherein the locking element comprises at least a blocking body, a bending zone, and an attachment portion;

wherein the locking element is attached in a recess in the panel by the attachment portion;

wherein the blocking body is connected to the attachment portion by means of the bending zone, the bending zone being formed of an elastic synthetic material with characteristics that are different than the material of the blocking body;

wherein said blocking body is substantially or entirely made of acrylonitrile butadiene styrene (ABS);

wherein the blocking body is configured as a pivoting blocking body, the locking element being configured such that the blocking body during joining executes a to and fro movement, wherein the locking element initially is pushed aside as a consequence of the downward movement of the male part, the blocking body having a guiding surface making a sliding contact with material of an opposite panel, the guiding surface being formed in said acrylonitrile butadiene styrene (ABS).

2. The panel of claim 1, wherein said blocking body on one extremity forms a stop-forming locking portion which can cooperate with a locking portion of a similar coupled panel.

3. The panel of claim 1, wherein the attachment portion retains the strip in the recess and is formed of a material having characteristics different than the material of the blocking body.

4. The panel of claim 1, wherein the locking element consists of a coextruded synthetic material strip with, seen in cross-section, a plurality of zones of synthetic material with different features including at least a first zone formed by said blocking body and at least a second zone formed by said bending zone.

5. The panel of claim 1, wherein said locking element is arranged in the recess in said male part and wherein said blocking body is configured as an upwardly directed blocking body.

6. The panel of claim 1, wherein the panel has a thickness of 15 millimeters or less.

7. The panel of claim 1, wherein the panel substantially is composed of a core material and a decorative top layer.

8. The panel of claim 1, wherein the attachment portion is formed of a material having characteristics the same as the material of the blocking body.

* * * * *